US006307332B1

(12) United States Patent
Noguchi et al.

(10) Patent No.: US 6,307,332 B1
(45) Date of Patent: Oct. 23, 2001

(54) LAMP LIFE METER AND ENDOSCOPE LIGHT SOURCE UNIT

(75) Inventors: Toshiaki Noguchi, Shirakawa; Isamu Karasawa, Hachioji; Nobuo Moriya; Terutoshi Shigemoto, both of Shirakawa; Koji Saito, Nishigo-mura, all of (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 09/525,880

(22) Filed: Mar. 15, 2000

(30) Foreign Application Priority Data

Mar. 15, 1999 (JP) ..... 11-068611

(51) Int. Cl.[7] ..... H05B 37/02

(52) U.S. Cl. ..... 315/362; 315/360; 600/118; 600/178; 348/65; 348/68

(58) Field of Search ..... 315/158, 199, 315/241.3, 360, 362; 348/65, 68, 75; 600/118, 178, 180; 362/276

(56) References Cited

U.S. PATENT DOCUMENTS 4,834,071 * 5/1989 Hosoi et al. ..... 128/6
5,627,584 * 5/1997 Nishikori et al. ..... 348/72
5,730,702 * 3/1998 Tanaka et al. ..... 600/180

FOREIGN PATENT DOCUMENTS 6-109981 * 4/1994 (JP) .
7-289510 * 11/1995 (JP) .
WO 9306437 4/1993 (WO) .

* cited by examiner

*Primary Examiner*—Haissa Philogene
(74) *Attorney, Agent, or Firm*—Ostrolenk, Faber, Gerb & Soffen, LLP

(57) ABSTRACT

A light source having a lamp for generating light generates a lamp on signal at an output terminal thereof when the lamp is lit. A lamp life meter is connected to the light source for detecting the time that the lamp has been lit. The lamp life meter includes a housing having at least one contact terminal adapted to be coupled to the output terminal of the light source, a clock generator located in the housing and generating clock signals, a counter located in the housing and counting the clock signals whenever the clock on signal indicates that the lamp is on and a display mounted in the housing for displaying an indication of the time the lamp has been turned on.

57 Claims, 15 Drawing Sheets

| LCD DISPLAY (□:UNLIT ■:LIT) | LAMP OF THE LIGHT SOURCE | | |
|---|---|---|---|
| □□□□□□ □ □□ | UNLIT | | |
| ■□□□□□ □ □□ | 0 ≤ | LIGHTING TIME IN HOURS | < 50 |
| □■□□□□ □ □□ | 50 ≤ | | < 100 |
| □□■□□□ □ □□ | 100 ≤ | | < 150 |
| □□□■□□ □ □□ | 150 ≤ | | < 200 |
| □□□□■□ □ □□ | 200 ≤ | | < 250 |
| □□□□□■ □ □□ | 250 ≤ | | < 350 |
| □□□□□□ ■ □□ | 350 ≤ | | < 450 |
| □□□□□□ □ ■□ | 450 ≤ | | < 500 |
| □□□□□□ □ □■ | LIGHTING TIME OF 500 HOURS OR MORE | | |

*FIG. 12*

| LCD DISPLAY (□:UNLIT ■:LIT) | TIME | | |
|---|---|---|---|
| ■□□□□□ □ □□ | 0.0 ≤ | DISPLAY TIME IN SECONDS | < 0.5 |
| ■■□□□□ □ □□ | 0.5 ≤ | | < 1.0 |
| ■■■□□□ □ □□ | 1.0 ≤ | | < 1.5 |
| ■■■■□□ □ □□ | 1.5 ≤ | | < 2.0 |
| ■■■■■□ □ □□ | 2.0 ≤ | | < 2.5 |
| ■■■■■■ □ □□ | 2.5 ≤ | | < 3.0 |
| ■■■■■■ ■ □□ | 3.0 ≤ | | < 3.5 |
| ■■■■■■ ■ ■□ | 3.5 ≤ | | < 4.0 |
| ■■■■■■ ■ ■■ | LIGHTING TIME OF 4.0 SECONDS OR MORE | | |

*FIG. 13*

LAMP LIFE METER AND ENDOSCOPE LIGHT SOURCE UNIT

BACKGROUND OF THE INVENTION

The present invention relates to a lamp life meter for displaying the remaining life of a lamp that emits light to be provided to an endoscope.

In recent years, endoscopes have been widely used in both medical and industrial fields. Such endoscopes typically include a light-guiding means which guides light emitted from an external light source to the endoscope to the distal end of the insertion section of the endoscope. This light illuminates a body cavity or the inside of a machine to be viewed with the endoscope.

One typical light source is a xenon lamp (or an iodine lamp or metal halide lamp) which is installed in an endoscope light source unit to provide illuminating light to the endoscope. The life of such a lamp is limited and must be replaced after its life expectancy has expired.

To avoid the possibility that the lamp will burn out or generate insufficient light while the endoscope is in use (which would hinder a correct diagnosis), it is necessary to correctly notify the user when the life of the lamp will end. Traditionally, a conducting time counting meter (hereinafter referred to as "lamp life meter") has been used to achieve this result.

FIGS. 16(A), 16(B) and 17 show a traditional lamp life meter 81. FIGS. 16(A) and 16(B) are front and side views of the traditional lamp life meter 81, which is covered with a resin case and has a graded scale 82. The graded scale illustrated in the drawing can count a maximum of 500 hours. A positive input terminal 84 and a negative input terminal 85 extend from the lower part of the main body of the lamp life meter 81 and energize the lamp life meter 81.

FIG. 17 shows the principle of operation of the lamp life meter 81. The traditional lamp life meter 81 includes a glass tube 86 housing mercury 87 and an electrolyte solution 88. When a direct-current voltage is placed between the electrodes (input terminals 84 and 85), mercury 87 is electrolytically extracted from the anode side to the cathode side via the electrolyte solution 88, and the electrolyte solution 88 is moved from the cathode side to the anode side.

Since the distance the electrolyte solution moves is proportional to the quantity of electricity flowing, the total conducting time (i.e., the time that current has been flowing through the lamp and therefore through the terminals 84, 85) can be shown, assuming that a constant current flows through terminals 84 and 85.

With the traditional lamp life meter 81, a circuit is provided in the light source unit to provide a minimal-ampere (15 $\mu$A) direct-current voltage, and the light source unit's main body and the lamp life meter 81 are connected with a socket so that it is detachable.

The traditional light source unit's main body has the same structure as the light source unit's main body illustrated in FIG. 2 described below.

The lamp life meter 81 is energized through the lamp-lighting circuit 12 (FIG. 2). When the lamp 11 is lit, a current of approximately 15 $\mu$A, which is suitable for driving the lamp life meter 81, is provided to the lamp life meter socket 6*a* (and/or 6*b*).

Traditional lamp life meters of the foregoing type have the following advantages:

a. They are easy to use;

b. They are compact;

c. They are relatively low-priced; and d. They reliably count the conduction time (and therefore the time that the lamp has been lit) and simply display it.

Generally, lamps used for the endoscope light source unit are consumed over time. Additionally, the quantity of light (the quantity of light shot from the distal end of the endoscope) is also reduced over time. Generally, the end of the lamp life means that; there is an unsatisfactory reduction in the quantity of light or that the lamp does not light.

A lamp life meter is traditionally installed on the endoscope light source unit, so that the remaining lamp life can be confirmed before use, and so that the lamp can be replaced with a new one when an insufficient lamp life remains.

While mercury having a high purity of 99.99% is used in traditional lamp life meters, the number of manufacturers producing such high-level mercury has been reduced. Additionally, some of mercury refineries have been closed, making it difficult to procure the required mercury used in traditional lamp life meters.

BRIEF SUMMARY OF THE INVENTION

The present invention is intended to act as a substitute for the traditional lamp life meters and serves the same functions without the use of mercury. Preferably, the lamp life meter of the present invention is compatible with endoscope light source units designed to accept the traditional lamp life meter.

A lamp life meter compatible with traditional lamp life meters can be provided by realizing a lamp life meter detachably attached to a lamp life meter socket that can place a minimal-ampere direct-current voltage between two terminals when in an endoscope light source unit comprising a lamp emitting light for viewing through an endoscope and a lamp-lighting circuit providing lamp-lighting power for lighting said lamp, said lamp is lit, wherein a means is provided to display the lamp life by detecting the time for which said direct-current voltage is placed between said two terminals of said lamp life meter socket.

The invention is directed towards a lamp life meter adapted to be detachably coupled to a light source of the type which generates a lamp on signal indicating that a lamp of said light source is turned on. The lamp life meter detects the total length of time that the lamp is turned on. The lamp life meter comprises:

- a housing having at least one contact terminal adapted to be coupled to one or more output terminals of said light source, said lamp on signal appearing on one or more of said output terminals when the lamp is on;
- a clock generator located in said housing and generating clock signals;
- a counter located in said housing and counting said clock signals whenever said lamp or signal indicates that said lamp is on; and
- a display mounted in said housing for displaying an indication of the time said lamp has been turned on.

The lamp life meter preferably includes a power source (a battery) located in the housing for powering the lamp life meter. A switch is provided for preventing power from being applied from the battery to said clock, counter and display.

The switch preferably comprises an insulating tab moveable between a first position wherein it prevents power from the battery from being applied to the clock, counter and display and a second position wherein it permits power from the battery to be applied to the clock, counter and display.

The tab is preferably slidable between the first and second positions and has an indication (e.g. an arrow head) formed therein indicating the direction the tab must be moved to bring it from the first to the second position. In some embodiments the tab has an insulating section and a conducting section. The insulating section is located between the battery and the clock, counter and display when the tab is in the first position. The conducting section is located between the battery and clock, counter and display when the tab is in the second position. The conducting section may have a conductive material formed over an insulating substrate or may be a hole formed in the tab. The tab can include a perforated portion which can be torn off from the remainder of said tab.

The display preferably includes a plurality of LED's. The pattern of the LED's which are lit indicate the time period that said light has been lit. The LED's preferably flash when they are lit to save energy.

The counter is preferably a programmed microprocessor which is programmed to carry out one or more tests concerning the operation of the lamp life meter. These tests can include a test to determine if the display is working properly and a test to determine if the counter is working properly.

The microprocessor preferably backs up the count of the counter to a non-volatile memory when the lamp on signal is removed from the at least one contact terminal. The microprocessor preferably switches to a sleep mode when the lamp on signal does not appear at the at least one contact terminal.

The invention is also directed to the combination of a light source having a lamp for generating light, the light source generating a lamp on signal at an output terminal thereof, and the lamp life meter described above.

BRIEF DESCRIPTION OF THE DRAWINGS

Other features and advantages of the present invention will become apparent from the following description of the invention which refers to the accompanying drawings.

FIG. 12 is a chart showing the preferred mode of operation of the LCD display during the normal mode of operation.

FIG. 13 is a chart showing the preferred operation of the LCD display during a test mode of the LCD display.

DETAILED DESCRIPTION OF THE PREFERRED EMBODIMENT

Figure 1:
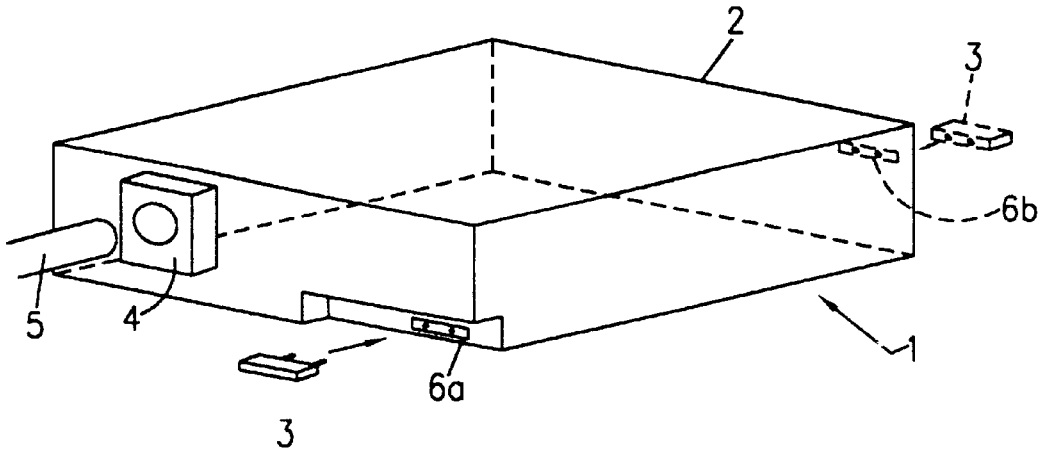
FIG. 1 is a perspective view of an endoscope light source unit incorporating a lamp life meter according to a first embodiment of the present invention.

Referring further to the drawings wherein like numerals indicate like elements, there is shown in FIG. 1 an endoscope light source unit 1 and a lamp life meter 3 constructed in accordance with the principles of the present invention. The lamp life meter 3 is detachably attached to the light source unit's main body 2.

On the front face of the light source unit's main body 2, is arranged a connector support 4 for detachably receiving the light guide connector 5 of an endoscope (not shown). When the light guide connector 5 is connected as shown in FIG. 2, illuminating light can be provided.

A lamp life meter socket 6*a* to which the lamp life meter 3 can be mounted is provided, for example, on the lower part of the front face of the light source unit's main body 2. A lamp life meter socket 6*b* to which the lamp life meter 3 can be mounted may also be provided on the reverse face of the light source unit's main body 2 either in lieu of, or in addition to, the lamp life meter socket 6*a*. The light source unit's main body 2 has the same configuration as that of the traditional light source unit's main body 2. The sockets 6*a* and 6*b* can receive either the traditional lamp life meter 81 or the lamp life meter 3 of the present invention.

Figure 2:
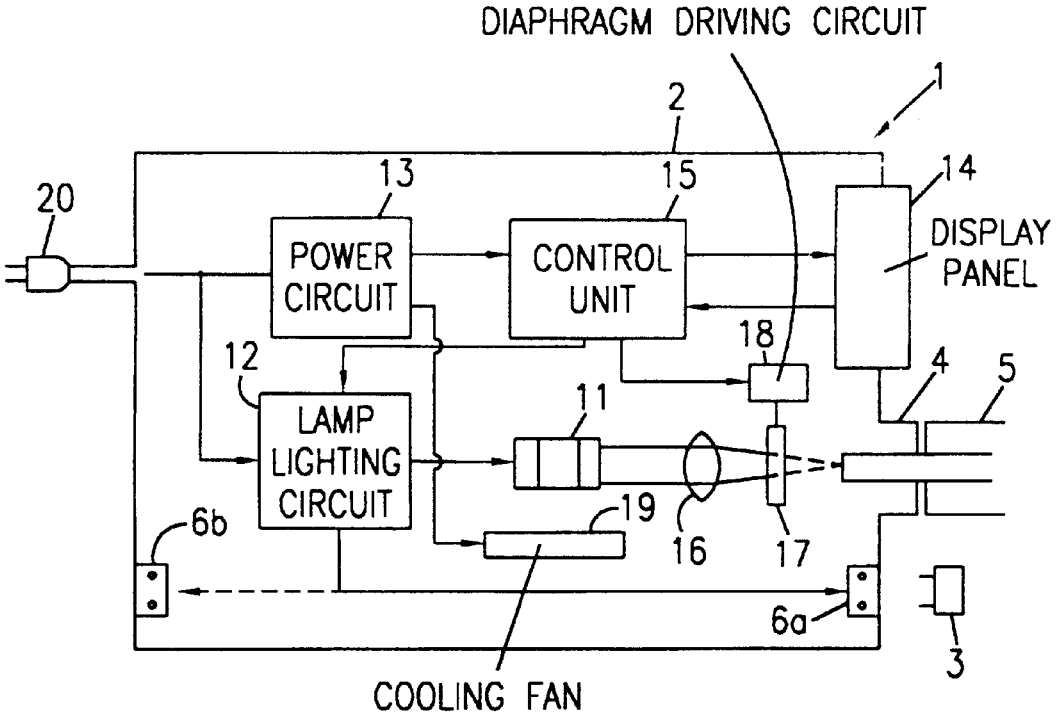
FIG. 2 is a schematic view showing the general configuration of the endoscope light source unit of FIG. 1.

As shown in FIG. 2, the endoscope light source unit 1 comprises a lamp 11 (a xenon lamp, for example) emitting illuminating light to be provided to the light guide connector 5 connected to the connector support 4, a lamp-lighting circuit 12 providing lamp-lighting power for lighting the lamp 11, a power circuit 13 for energizing various circuits including the lamp-lighting circuit 12, a display panel 14 constituted of various switches and display means (LED display equipment, etc.) arranged on the front panel section of the light source unit's main body 2, a control unit 15 for switching the lamp 11 on and off and controlling the brightness of the lamp according to signals received from the display panel 14 via the lamp-lighting circuit 12, a condensing lens 16 for condensing illuminating light emitted from the lamp 11 and providing it to the light guide connector 5 of the endoscope, a diaphragm 17 for controlling the quantity of illuminating light to be provided to the light guide connector 5, a diaphragm-driving circuit 18 for adjusting the opening of the diaphragm 17, a cooling fan 19 for radiating (cooling) heat generated by the lamp 11, and a lamp life meter socket 6*a* (or 6*b*) connected to the lamp-lighting circuit 12, wherein commercial electrical power can be provided to the power circuit 13 via the AC plug 20.

The lamp-lighting circuit 12 includes a circuit that detects the fact that the lamp 11 is on, and outputs signals to the lamp life meter socket 6*a* (or 6*b*) only during the period that the light is lit. In the following description, it is assumed that only the lamp life meter socket 6*a* is provided.

The lamp life meter is energized through the lamp-lighting circuit 12 (which is controlled by the control unit 15) when the lamp 11 is lit. During this time period, a current of approximately 15 $\mu$A (which is suitable for driving the lamp life meter 3) is provided to the lamp life meter socket 6*a*.

Figure 3A:
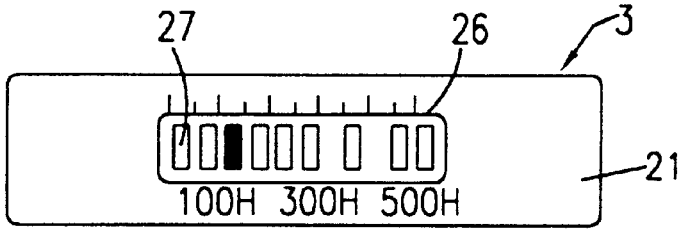
FIG. 3(A) is a top view of the lamp life meter of FIG. 1.
Figure 3B:
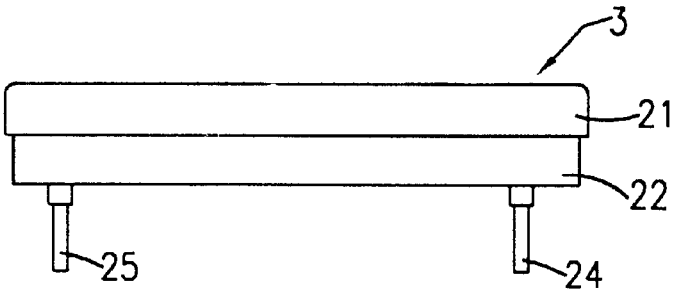
FIG. 3(B) is a side view of the lamp life meter.

As shown in FIGS. 3(A) and 3(B), lamp life meter 3 is generally rectangular in shape; its upper face (surface, front face) and bottom face (reverse face) being covered with an upper cover 21 and a lower cover 22, respectively. Its dimensions and appearance are substantially the same as the traditional lamp life meter 81. A positive (+) input terminal 24 and a negative (−) input terminal 25 are arranged on the reverse face of the lamp life meter 3. The shape of and the distance between these input terminals 24 and 25 are identical to those of the traditional lamp life meter 81. The lamp life meter 3 can be inserted into the lamp life meter socket 6*a* in lieu of the traditional lamp life meter 81.

A liquid crystal display device (LCD) 26 is provided as a display means for showing the remaining lifetime of the lamp based on the total time that the lamp 11 has been lit.

The LCD 26 is preferably arranged on a rectangular window situated around the center of the upper cover 21 and may take the form of a bar display section 27 which changes, for example, after every 50-hour use.

According to the present embodiment, the next bar blinks every 50 hours from the start of counting the use of the lamp until the lamp has been used for a total of 300 hours. The next two bars blink every 100 hours from 300-hour use to 500-hour use. The highest-rank bar blinks after 500-hours of use. While such intervals are described by way of example, any desired set of intervals and any desired display may be provided.

Figure 4:
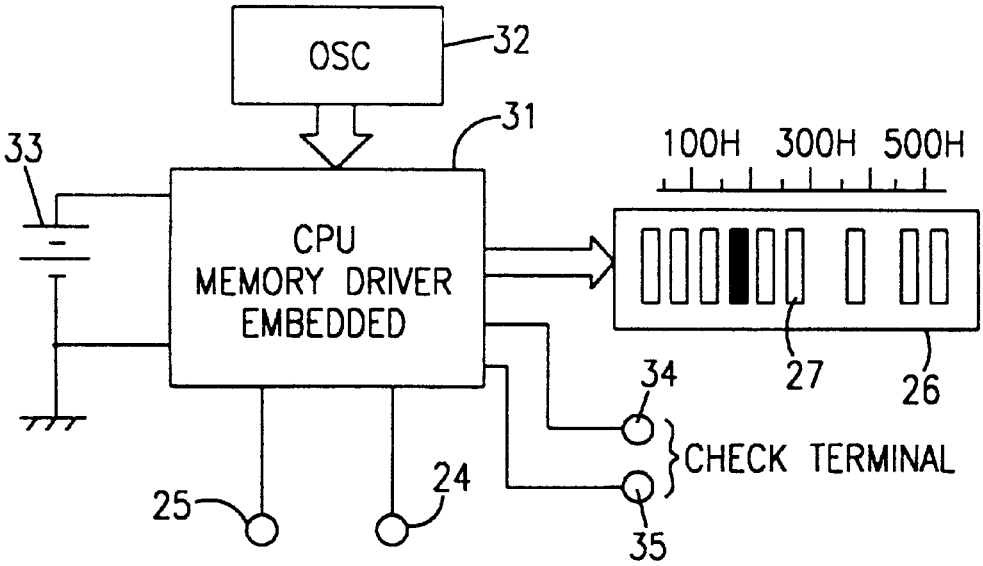
FIG. 4 is a block diagram showing the general configuration of the electrical system of the lamp life meter.

FIG. 4 is a schematic view of the electric system of the lamp life meter 3. It includes a CPU that counts the total time that the lamp 11 has been lit based on signals it receives from input terminals 24 and 25, and outputs display signals to the LCD 26, an oscillator (OSC) 32, for example, a crystal oscillator, that produces clock signals with the lapse of time that are counted by the CPU 31 when the lamp on signal from the light source unit 1 appears on input terminals, an LCD (LCD panel in FIG. 5) 26 for showing the total time that the lamp 11 has been used, a battery 33 that provides power to drive the CPU 31 and back up the elapsed time, and input terminals 24 and 25 for receiving lamp-lighting signals from the light source unit's main body 2.

The CPU 31 is preferably a chip microprocessor on which various input and output ports and memories are mounted; and lamp-lighting signals are applied to an input port, and the LCD 26 is connected to an output port. The terminals 34 and 35 are connected to the CPU 31. To check operation of the lamp life meter 3 according to the present embodiment: it is possible to obtain access to the lamp life meter 3 from the outside.

The traditional lamp life meter 81 is activated by a minimal-ampere current of approximately 15 $\mu$A, and only a current of up to 15 $\mu$A can be output from the lamp life meter socket 6*a* of the light source unit's main body 2.

In order to be compatible with light sources designed for use with the traditional lamp life meter 81, it is preferred that the lamp life meter 3 meet the following conditions:

a. The total time is counted as soon as the lamp-on signal (of around 15 $\mu$A) is output from the light source unit (i.e., the signal appearing at socket 6*a*);

b. The total elapsed time is shown while the total elapsed time is being counted;

c. When the lamp-on signal (5 $\mu$A) is interrupted, counting of the elapsed time is stopped, and the total elapsed time at that point is backed up;

d. When the lamp-one signal (15 $\mu$A) is output again from the light source unit, counting of the total elapsed time is restarted from the total elapsed time figure backed up when the lamp-on signal was previously stopped;

e. Only an elapsed time of a predetermined number of hours (e.g., 500 hours) can be counted, and when that number of hours is exceeded, the highest of the LCD bar display section 27 should be displayed;

f. The life of the battery should be greater than the predetermined number of hours (e.g., 500 hours) in the continuous operation state for counting the total time; and the life of the LCD should exceed two years in the stand-by state. Like all of the listed requirements, this requirement is not absolute because it depends on the particular characteristics of the light source unit;

g. Means should be provided to ensure that power is not applied to the lamp life meter 83 before its initial use so that the battery will not be consumed;

h. The dimensions and appearance are almost the same as those of the traditional lamp life meter.

In order to have these desired attributes, the present embodiment is modular in design, uses a button-type battery 33 as the power for driving circuits and is configured as follows.

The CPU 31 is of the low power consumption type: 50 to 30 $\mu$A when in the operation mode, while 2 to 1 $\mu$A when in the sleep mode (stand-by mode). In addition, each port of the CPU uses a pull-down circuit in order to restrain the power consumption from increasing due to the presence of a pull-up resistor, for example. An LCD 26 using 0.5 to 1 $\mu$A is preferably used.

In order to ensure that power is not applied to the CPU before the lamp life meter 3 is used with a lamp source unit 1, an insulating means is provided between a terminal of the battery 33 and a terminal of the battery holder.

Referring to FIGS. 5(A)–5(E), the detailed construction of the present embodiment will be described.

As shown in these figures, an upper cover 21 on the display face side and the lower cover 22 on the side for insertion into the socket 6*a* can be fit into one another with a single motion to form an outer case.

An opening is formed in the upper cover 21 so that the bar display section 27 (FIG. 4) of the LCD panel 26 can be seen. Below the opening is a circuit board 41 on which LCD panel 26, a conductive rubber (for example, Zebra™ Rubber) 40, electrical parts, etc., are installed.

Various other parts such as CPU 31, oscillator 32, battery holder 42, batteries 33, contact pins (input terminals 24 and 25), resistors, and a capacitor are formed on circuit board 41. A pattern for electrically connecting the LCD panel 26, the conductive rubber 40, and the output port of the CPU 31, are formed on the circuit board 41 which can be connected at the same time when the upper cover 21 and the lower cover 22 are fit together in a single motion.

Figure 5A:
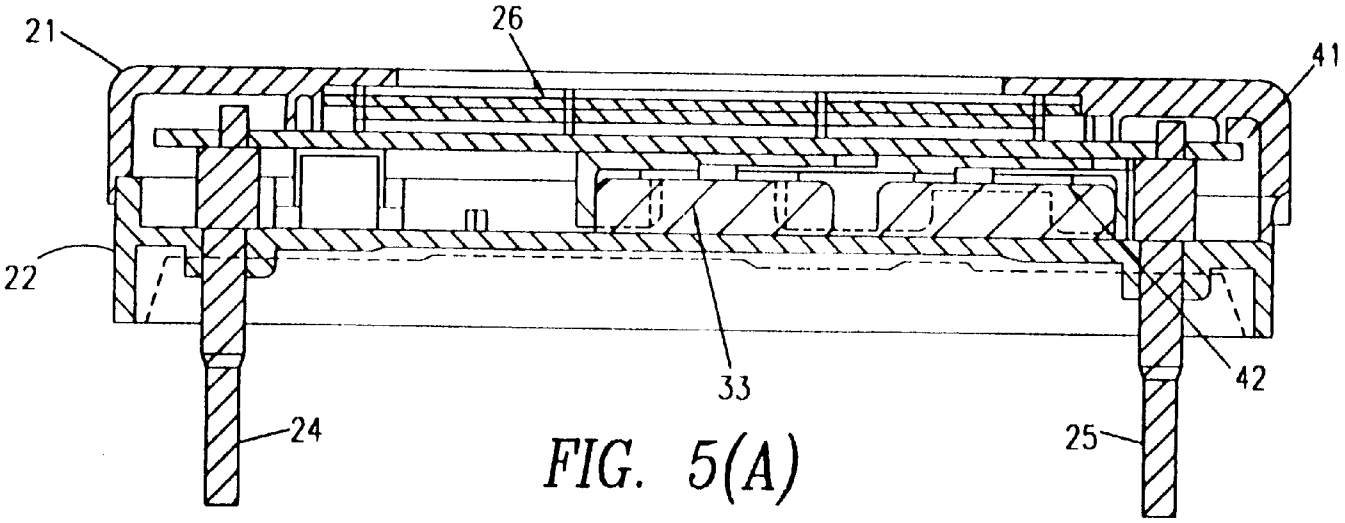
FIG. 5(A) is a front, sectional view of the lamp life meter.
Figure 5B:
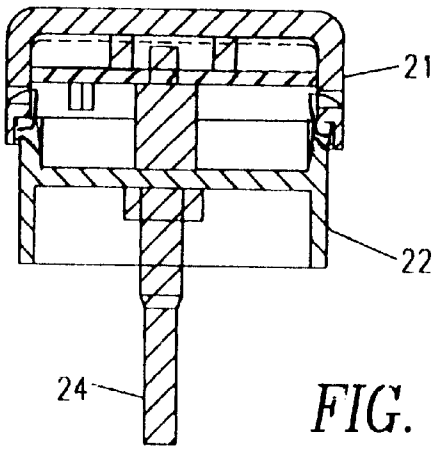
FIG. 5(B) is a side, sectional view of the lamp life meter.
Figure 5C:
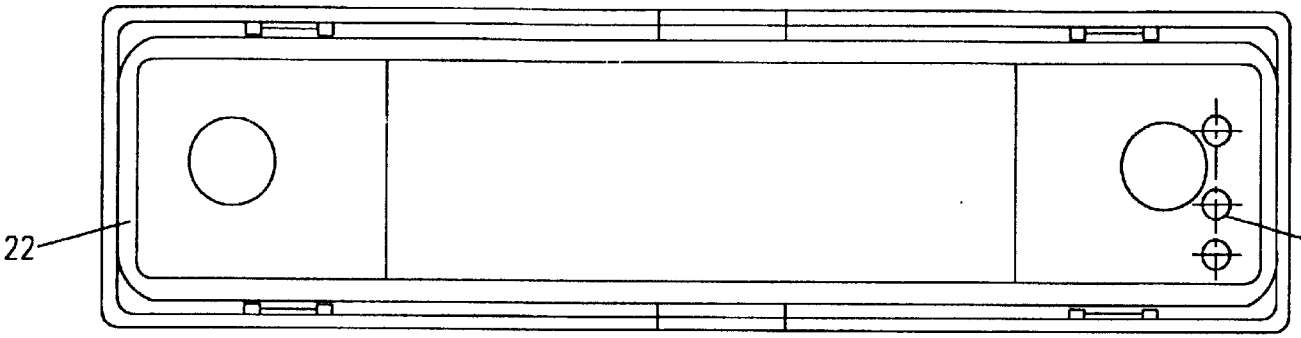
FIG. 5(C) is a bottom view of the lamp life meter.

On the lower cover 22, is arranged an check hole 43 (FIG. 5(C)) through which access can be obtained to check terminals 34 and 35 which are used for checking operation of the lamp life meter 3 during the manufacturing process or when the lamp life meter 3 is serviced.

Figure 5E:
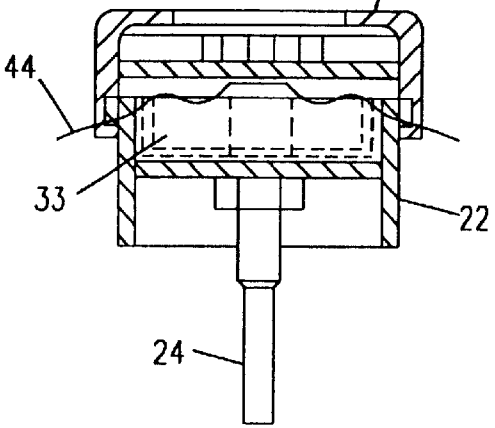
FIG. 5(E) is a side sectional view of the lamp life meter wherein the insulating tab is housed within the meter.
Figure 5D:
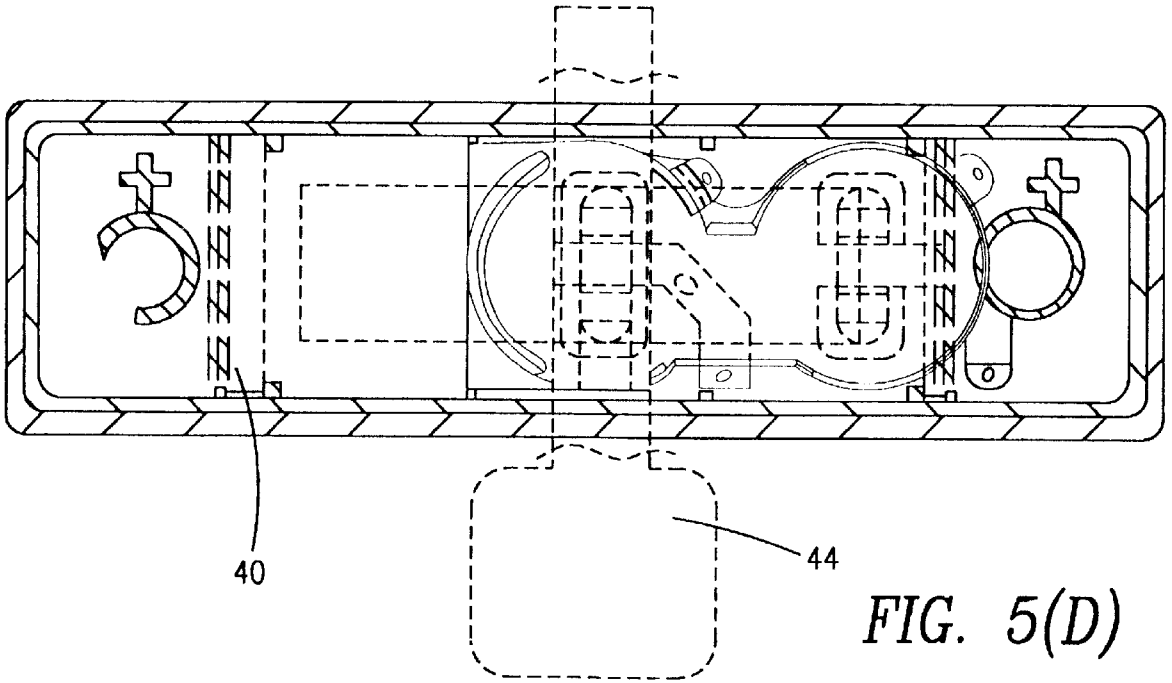
FIG. 5(D) is a top sectional view of the lamp life meter of wherein an insulating tab 44 is located within the lamp life meter.

As shown in FIG. 5(E), the battery 33 is prevented from being consumed by a film-like insulating tape 44 located between the battery 33 and the battery holder 42 before the lamp life meter 3 is installed in the light source unit 1. The insulating tape 44 operates as a switch which is moveable between a first position wherein power is applied to the circuits of the lamp life meter (including the CPU, the display and the oscillator) and a second position wherein the power is cut off.

Figure 6A:
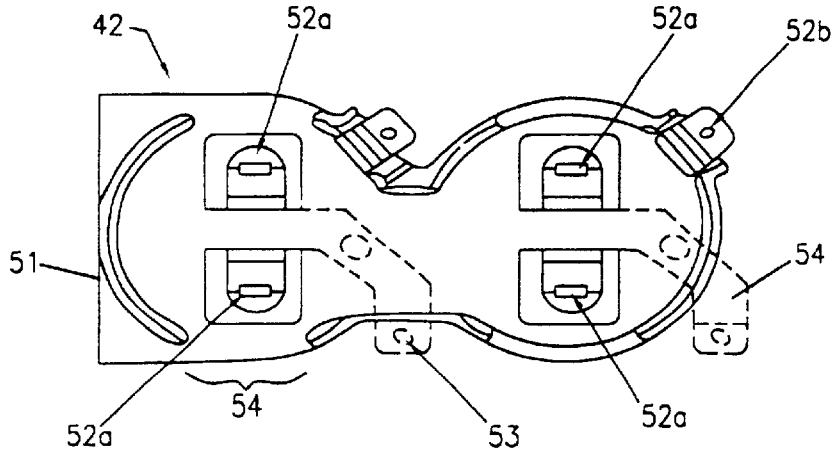
FIG. 6(A) is a top view of the battery holder forming part of the lamp life meter of FIG. 1.
Figure 6B:
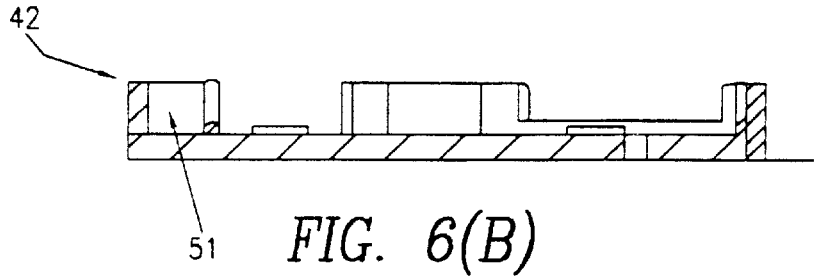
FIG. 6(B) is a sectional side view of the battery holder.
Figure 6C:
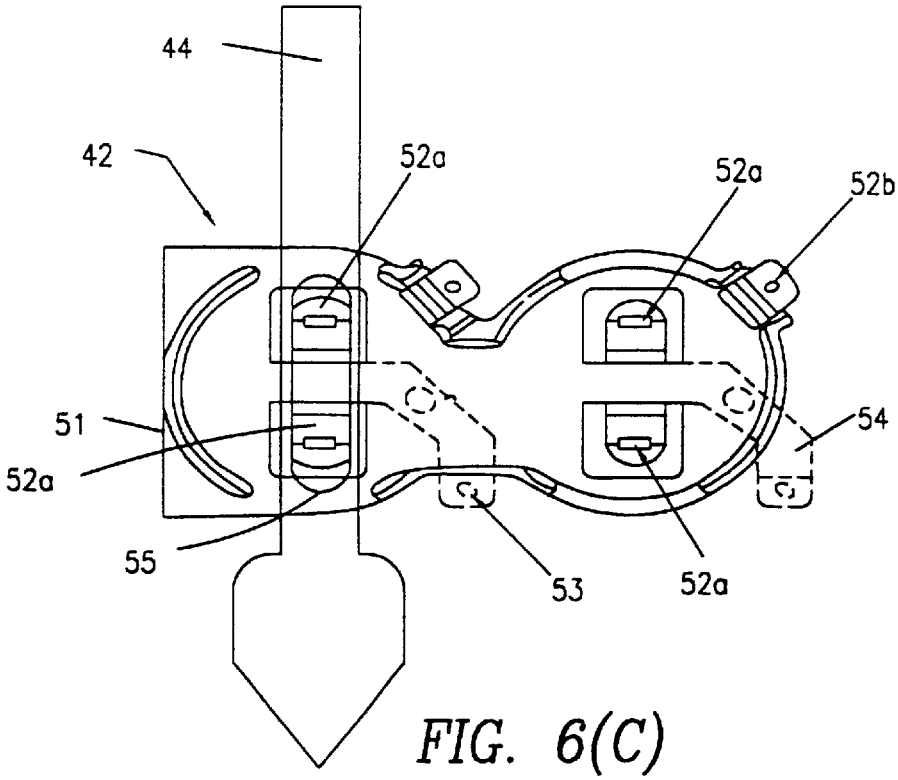
FIG. 6(C) is a top view of the battery holder with the insulating tab in place.

FIGS. 6(A)–6(C) show the details of the battery holder 42 and the power insulation structure. FIG. 6(A) is a top view of the battery holder 42; FIG. 6(B) is a longitudinal sectional view of the battery holder portion; and FIG. 6(C) shows how the insulating tape 44 covers the contacts 52*a*, 52*b* of the battery holder 42 (thereby insulating the contacts 52*a* from the terminal of the battery 33) while the insulating tape is in the illustrated position.

The battery holder 42 comprises a main body 51 designed to accommodate two batteries 33 and electrode contacts 52*a* and 52*b*. Contacts 52*a*, 52*b* are preferably spring type contacts. One pair of contacts 52*a* are coupled to a terminal 53 which is connected to a corresponding conductor on the circuit board 41 and a second pair of contacts 52*a* are coupled to a terminal 54 which is connected to a corresponding conductor on circuit board 41. Such structure allows an automatic substrate installation machine to mount the battery holder 42 on the circuit board 41.

Figure 7A:
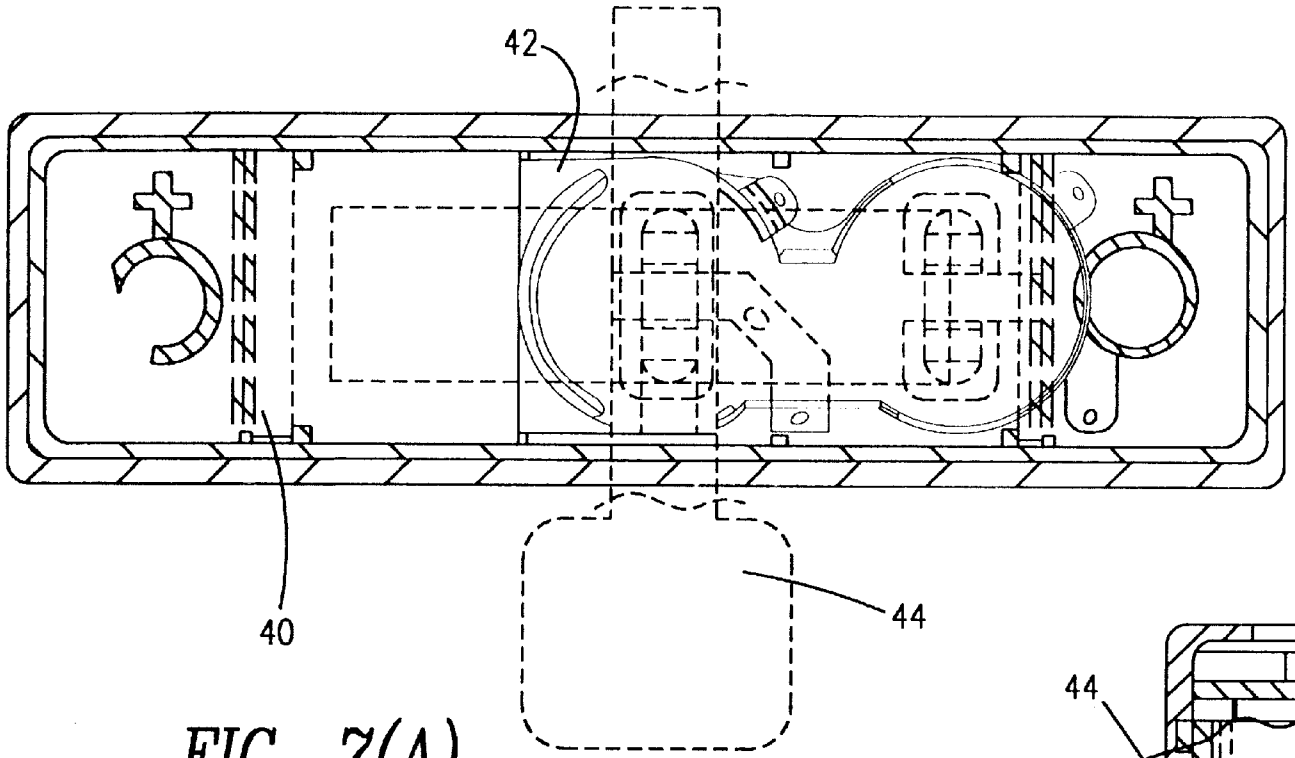
FIG. 7(A) is a top sectional view of the lamp life meter with the insulating tab in place.
Figure 7B:
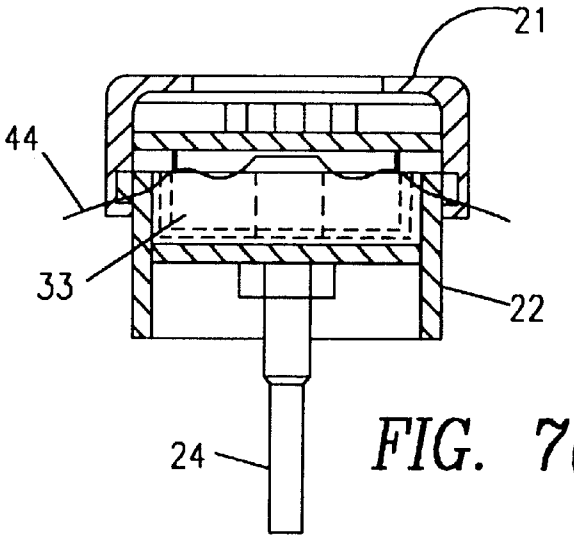
FIG. 7(B) is a side sectional view of the lamp life meter with the insulating tap in place.

A tape insertion hole 54 into which the insulating tape 44 can be inserted between the battery 33 and the electrode spring 52*a* (and from which it can be extracted afterwards) is formed on the main body 51 of the battery holder 42. The position of the insulating tape relative to one of the batteries 33 and the battery holder 42 is shown in FIGS. 7(A) and 7(B). In this embodiment, the entire insulating tape 44 is formed of an insulating material and must be removed from the lamp life meter 3 in order to permit battery power to be applied to the CPU.

Figure 7C:
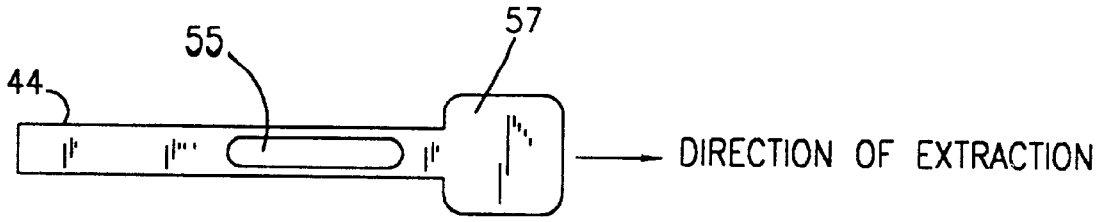
FIG. 7(C) is an alternative embodiment of the insulating tab.
Figure 7D:
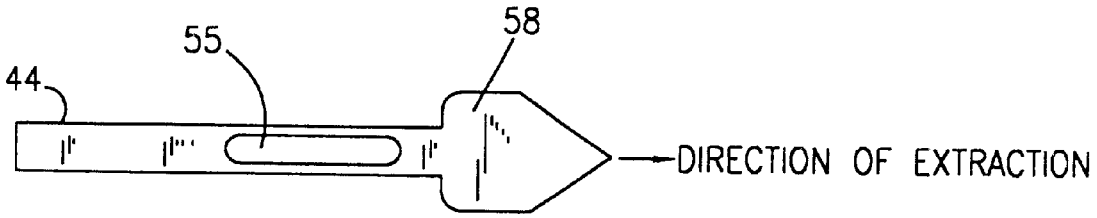
FIG. 7(D) is a further alternative embodiment of the insulating tab.
Figure 7E:
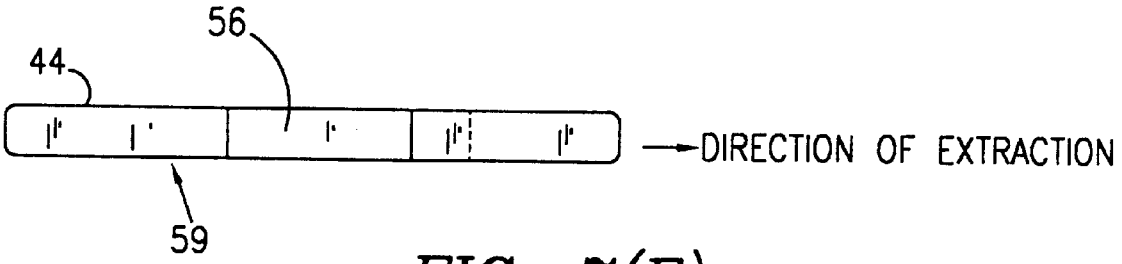
FIG. 7(E) is yet a further alternative embodiment of the insulating tab.

Alternative structures of insulating tape 44 are shown in FIGS. 7(C)–7(E). In each of these examples, the insulating tape 44 has a conducting means, such as an opening 55 or conducting member 56, in the center of the tape which is itself constituted of insulating material. When the tape is moved to a position wherein the conducting means is located between the battery terminal and the terminals 52*a*, electricity can flow between the electrode terminals 52*a* and the battery 33.

The end of the insulating tape 44 may take various shapes. The square shape 57 shown in FIG. 7(C) can be easily grabbed by hand. The arrow shape 58 shows the direction that the tape must be moved. Changing the color of the tape (not illustrated) makes it easy to judge whether the tape is inserted.

As shown in FIG. 7(E), the insulating tape 44 may be perforated at a location along which it can be torn.

The insulating means shown in FIG. 7(C)–7(E) make it possible to check the operation of the lamp life meter 3 at the factory without removing the insulating tape. Using any of these embodiments, the electrodes of the battery 33 and the terminals 52*a* are temporarily brought into conduction through the opening 55 of the insulating tape 44 (or through the conductive section 56) to check operation of the internal circuit during the manufacturing process of the lamp life meter 3. Since several test programs for operation test modes are stored in advance in the memory (for example, the PROM 61 in FIG. 10) embedded in the CPU 31, a test mode can be selected by choosing a test terminal of the CPU 31. After an operation test mode is selected, the testing operation is finished.

Next, the insulating tape 44 is extracted, and stopped in some insulating area other than the opening 55 or the conductive portion 56. In such a state, the lamp life meter 3 is shut off from the power, and all is reset.

As shown in FIG. 7(E), a perforation may be provided on the insulating tape. After the insulating tape 44 is extracted, and stopped in some insulating area other than the opening 55, the insulating tape 44 can be torn with the conductive member 56 to prevent a user's wrong manipulation from causing a current to be passed.

The CPU controls the operation of the lamp life meter 3 in accordance with a prestored operation program. In accordance with the preferred program, the lamp life meter 3 operates and the LCD 26 starts only when the lamp-lighting signals is applied to the input terminals 24 and 25, while the sleep mode (stand-by state) is selected to save the power consumption when the lamp-lighting signal is shut off. Moreover, the LCD 26 is not continuously lit, but blinks during operation to save power consumption.

The life meter 3 is detachably connected to the lamp life meter socket of the light source unit's main body 2 shown in FIG. 2, and power suitable for driving the lamp life meter 3 is provided to the lamp life meter socket 6*a* through the power circuit 13 when the lamp 11 is lit.

Figure 8:
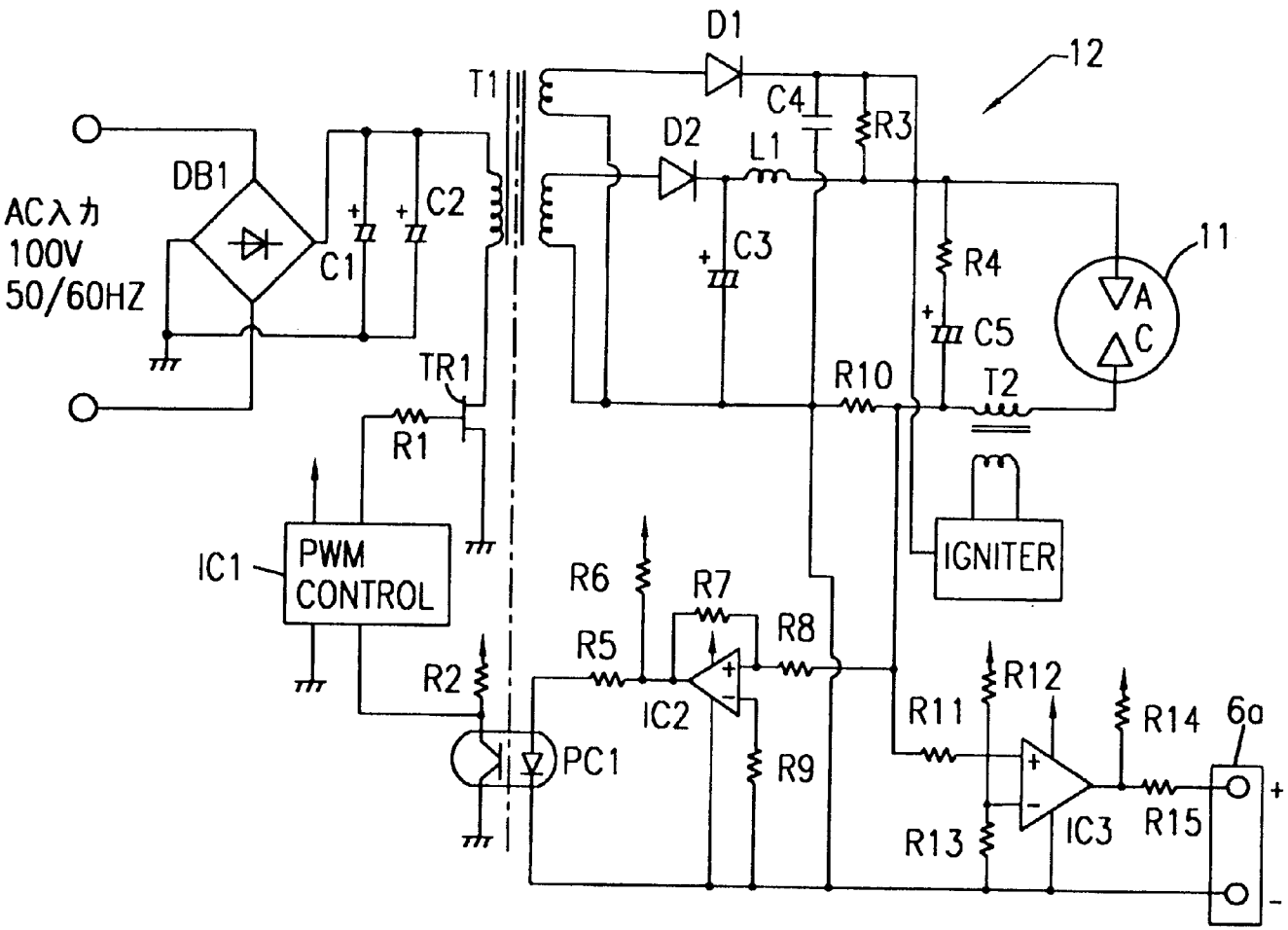
FIG. 8 is a circuit diagram of one possible electronic circuit to be used as pert of the lamp lighting circuit of FIG. 1.

FIG. 8 shows the one possible embodiment of the lamp-lighting circuit 12 used to light a xenon lamp used as the lamp 11. This circuit is of the PMW and the switching regulator type, which feeds back the current flowing to the lamp 11, and controls the lighting of the xenon lamp with a constant current.

An input AC power signal is commutated by the diode DB1, and smoothed by the smoothing capacitors C1 and C2. The PWM control circuit IC IC1 is connected to the gate of the switching transistor TR1 via the resistor R1, and the first winding of the inverter transformer T1 is connected to its source drain side. The PWM control circuit IC1 is connected to the photo-coupler PC1, and the phototransistor of the photo-coupler PC1 is connected of the end of the power source via the resistor R2.

As the configuration of the second circuit, smoothing capacitors C3 and C4, smoothing diodes D1 and D2, an inductor L1, etc. are arranged. The series circuit comprising the resistor R4 and the capacitor C5 is provided to supply a superimposed current for lighting the lamp 11 in an efficient manner. A coil T2, for applying a high voltage to the lamp 11 is connected to the igniter.

When the lamp 11 is lit, a voltage is generated between the ends of the current sensing resistor R10 to drive the photo-coupler PC1 via the photo-coupler-driving circuit IC2 through which the control circuit IC1 is fed back to light the lamp 11 by the constant current. Resistors R5 through R9 are connected to IC2.

The power for the lamp life meter 3 is provided to socket 6*a* by comparator IC3 via the resistor R15 used to control the current. When the lamp 11 is lit, the voltage generated between the ends of the current sensing resistor R10 is input to the noninverting input terminal of the comparator IC3 via the resistor 11, and is compared with the reference voltage located between resistors R12 and R13 to change the output from the comparator IC3 from the low "L" level to the high "H" level.

When at the "H" level, the resistor R15 connected in series with the end of the power source via the resistor R14 can provide the lamp life meter socket 6*a* with a current of approximately 15 μA for driving the traditional lamp life meter.

Figure 9:
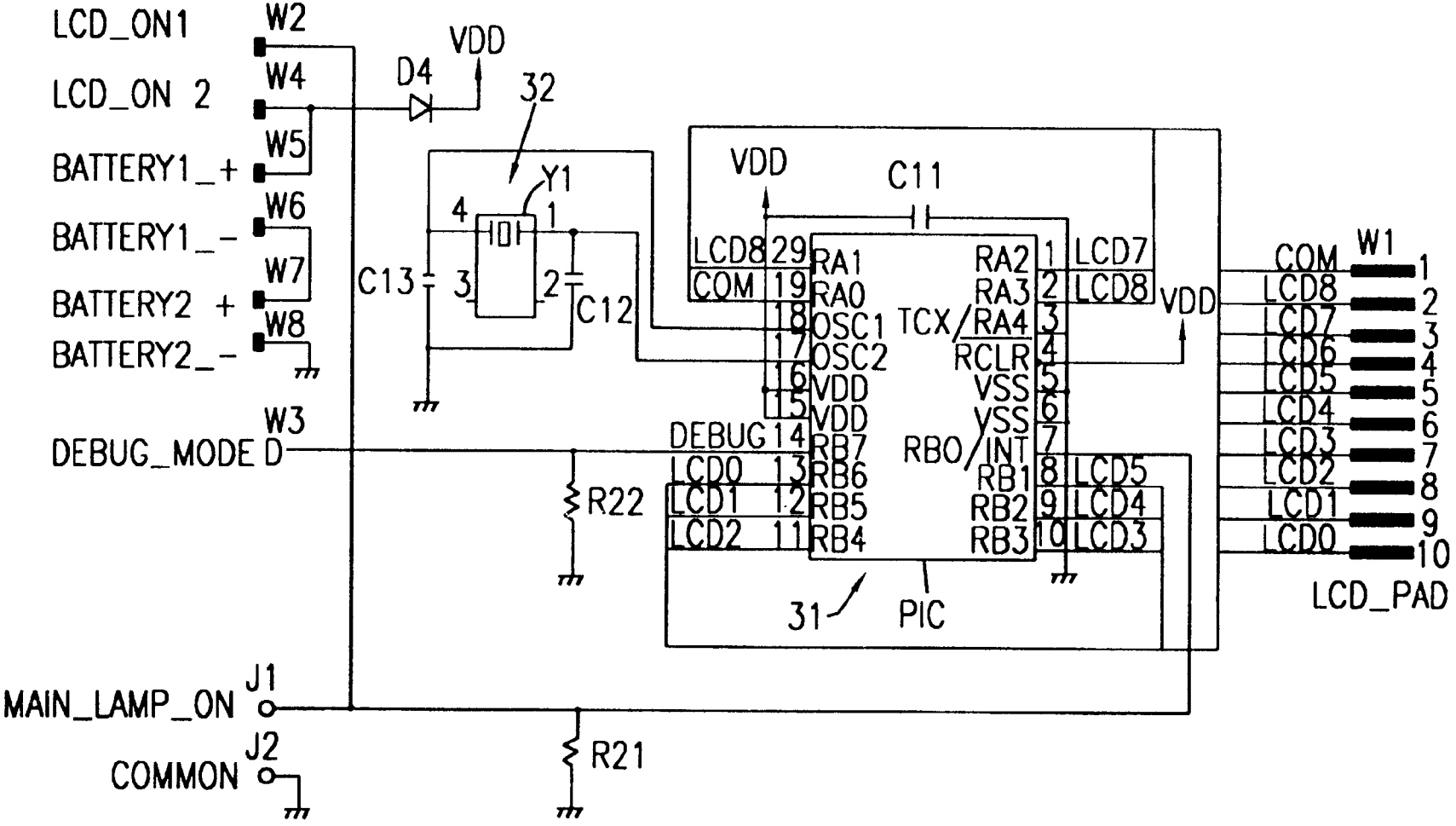
FIG. 9 is a wiring diagram showing one possible circuit implementing the lamp life meter using a chip microprocessor.

One possible circuit configuration for the lamp life meter 3 is shown in FIG. 9. The primary component of the lamp life meter 3 is CPU 31, a chip microprocessor (preferably a PIC16LC554) that counts the total time that the lamp 11 has been lit, and drives the LCD 26 to display that time. A capacitor 11 is placed between the power source VDD and ground.

The liquid crystal display panel, LCD 26, is connected to the pad of W1, via the conductive rubber (e.g., Zebra™ rubber).

The battery 33, comprising two silver oxide cells located in the battery holder 42, is connected to each pad W5 through W8 to provide a voltage of 3.1 volts. The voltage of 3.1 volts is dropped by the back-flow preventive diode D4 to around 2.8 volts, which is provided as the power source VDD for the microprocessor PIC.

When a voltage of +5 volts with an impedance of 240 KΩ (the signal provided from the lamp life meter socket 6*a* of the light source unit's main body 2) is input to terminal J1 (MAIN LAMP ON), a voltage of 2.2 to 2.8 volts (obtained through a voltage drop through the resistor R21 and the output circuit on the side of the light source unit's main body 2) is input to the 7 pin of the microprocessor PIC.

The pull-down resistors R21 and R22 are arranged to stabilize the input pins at ground potential when no input is applied. This is done to prevent the battery 33 from being consumed.

The crystal oscillator Y1, can be used as the oscillator 32 to produce clock signals for the microprocessor PIC. A fork oscillator of 32.768 KHz can be used to prevent the battery 33 from being consumed. An oscillation circuit is formed with the capacitors C12, C13, etc.

When a voltage of +5 volts with an impedance of 240 KΩ is provided to the pad of W3, the operating mode of the microprocessor PIC is switched to the debug mode to confirm operation of the LCD 26 and internal circuits. (This is the test mode mentioned above).

When the pads of W2 and W4 are shorted, the total time that the lamp has been lit is shown by the lamp life meter 3 without being connected to the light source unit's main body 2.

Figure 10:
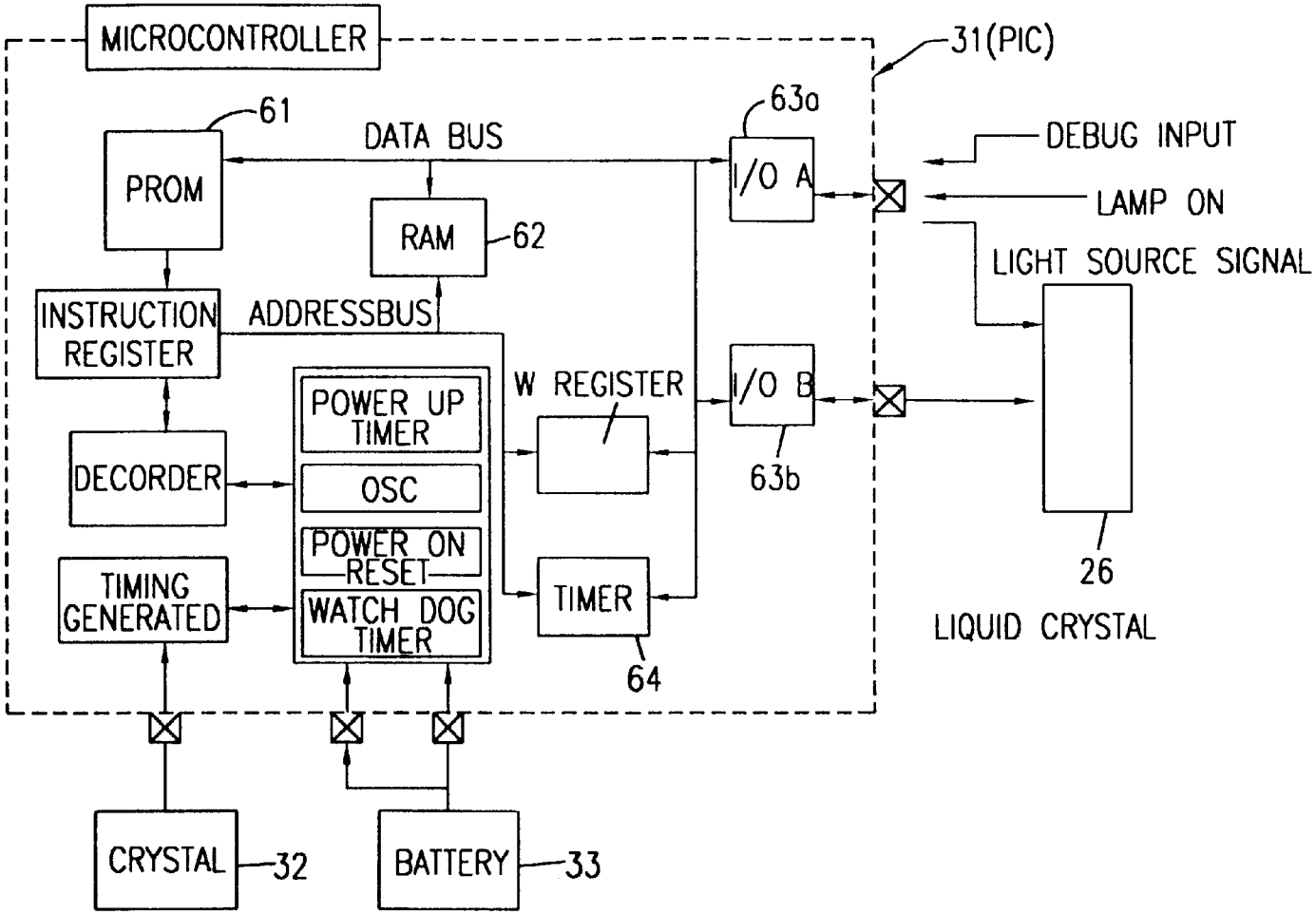
FIG. 10 is a block diagram showing the internal configuration of the chip microprocessor of FIG. 9.

For reference, FIG. 10 shows the internal configuration of the preferred microprocessor PIC. Basically, it comprises PROM 61, RAM 62, I/O A63b, I/O A3b, resistors, timer 64, oscillation unit, etc.

Since two 55 milliamps/hour, silver oxide cells are preferably used, the capacity is 110 milliamps/hour. Even when the batteries 33 are not used, however, their capacity will be reduced to 70% of the initial capacity due to natural discharge after five years.

In order to save power consumption, the following settings are preferably made for the microprocessor PIC: LP mode, on; watch dog timer, off; without input/output pull-up; power-supply voltage, 2.8 volts. Therefore, the power consumption is typically 26 μamps and maximum 53 μamps during the operation mode, and typically 0.7 μamps and maximum 2 μamps during the sleep mode.

The maximum power consumption of the LCD 26 is 1.3 μamps.

So constructed, the worst operable time can be estimated as follows.

During continuous operation: 110 milliamps/hour/(54.3 μamps×1 hour)=2025 hour<1417 hour>.

During the sleep mode: 1 μamps/(2 milliamps/hour×1 hour)=55500 hour<38500 hour>.

When 500 hour operation and the sleep mode: ((110 μamps−(500 μamps−(500 hour×59.3 milliamps/hour))/(2 milliamps/hour×1 hour)=41425 hour<28998 hour>.

N.B. A figure put in angle brackets is the operable time when the meter is first used after batteries 33 have been left unused for five years.

Since the worst happens rarely, the operable time is longer in most cases.

Actually measured value during operation: 20 milliamps/hour or less.

Actually measured value during sleep mode: 0.1 milliamps/hour or less.

An example of patterns displayed during the normal mode of operation are shown in FIG. 12.

Figure 11:
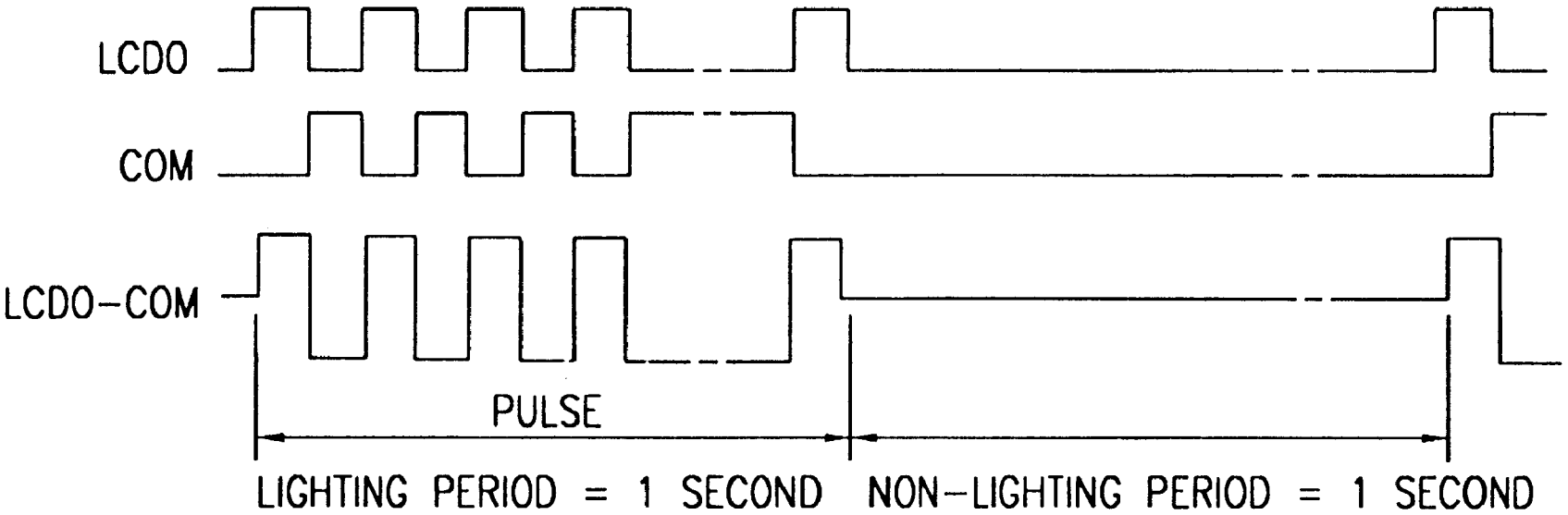
FIG. 11 is a timing diagram showing signals used to drive the LCD display of the lamp life meter.

As shown in the timing chart of FIG. 11, the LCD 26 driven by microprocessor PIC displays various patterns by inverting the potential between the bar to be lit and the common line 32 times a second. In order to save the battery 33 as much as possible, bars blink (they flash on and off every second). The patterns displayed vary as a function of the time the lamp 11 has been lit.

An example of patterns displayed during the check mode is shown in FIG. 13.

When a voltage of +5 volts with an impedance of 240 KΩ is provided to the DEBUG MODE pad, the mode is switched to the test mode, and patterns of the test mode are displayed. The test mode cannot be released unless power is shut off.

Figure 14:
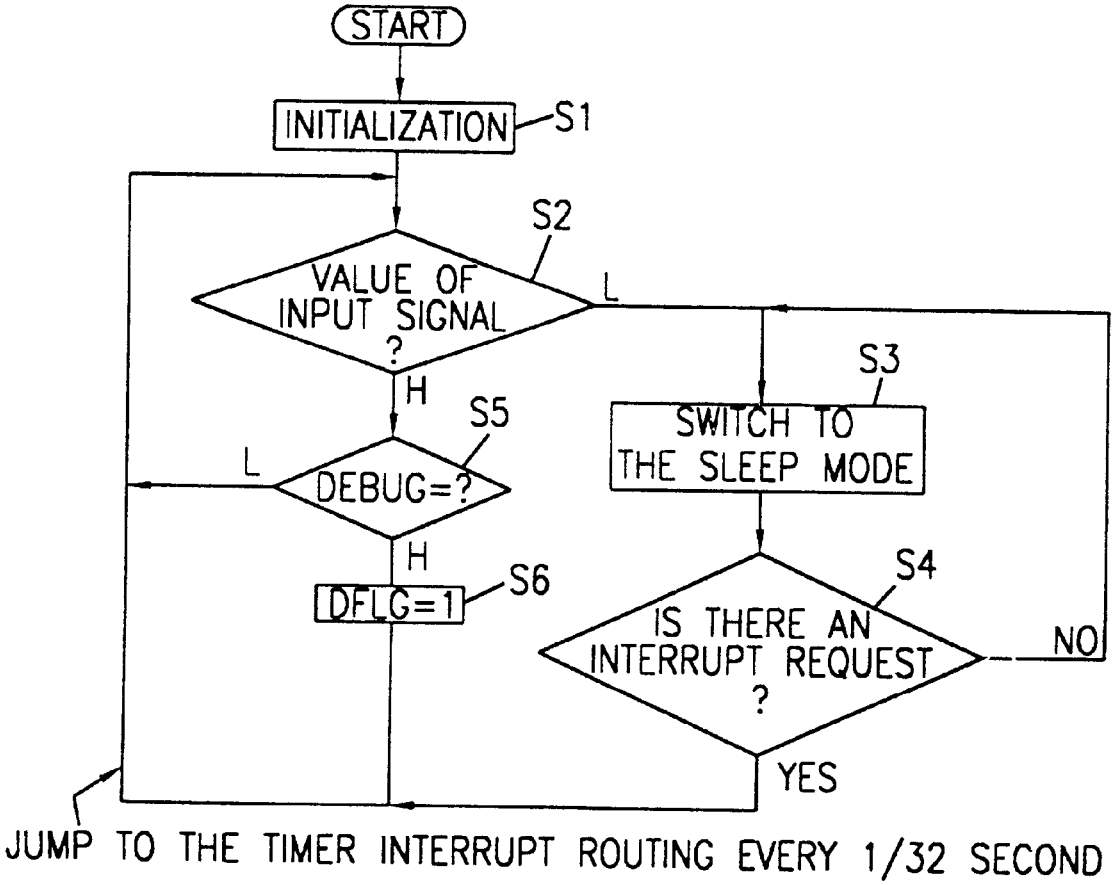
FIG. 14 is a flow chart showing the main routine carried out by the microprocessor of FIG. 9.

Next, the preferred algorithm of the internal program will be described. First, the main routine is shown in FIG. 14.

When the power is provided by the battery 33, the microprocessor PIC resets to start the program. When the program starts, an -initialization program runs to set the variable fields or constants as shown in Step S1. In Step 2, the microprocessor PIC determines whether the main-lamp-on signal is present. In the case of the "L" level where the signal is not present, the microprocessor PIC switches to the sleep mode, as shown in Step S3, to minimize power consumption.

In Step S4, the microprocessor PIC determines whether there is an interrupt request. If not, the sleep mode is maintained. When there is an interrupt request, the program returns to Step S2 to switch to the normal mode.

On the other hand, when the input signal is "H", indicating the main-lamp-on signal is present, the microprocessor PIC determines whether the debug signal input in Step S5. When the input signal is "L", where the debug signal is not input, the program returns to Step S2. When the input signal is "H", it returns to Step S2 after setting the check mode flag (DFLG) to 1 in Step S6.

Steps S2 through S6 are repeated. A timer interrupt arises every 1/32 second, and the program branches to the interrupt routine.

Figure 15:
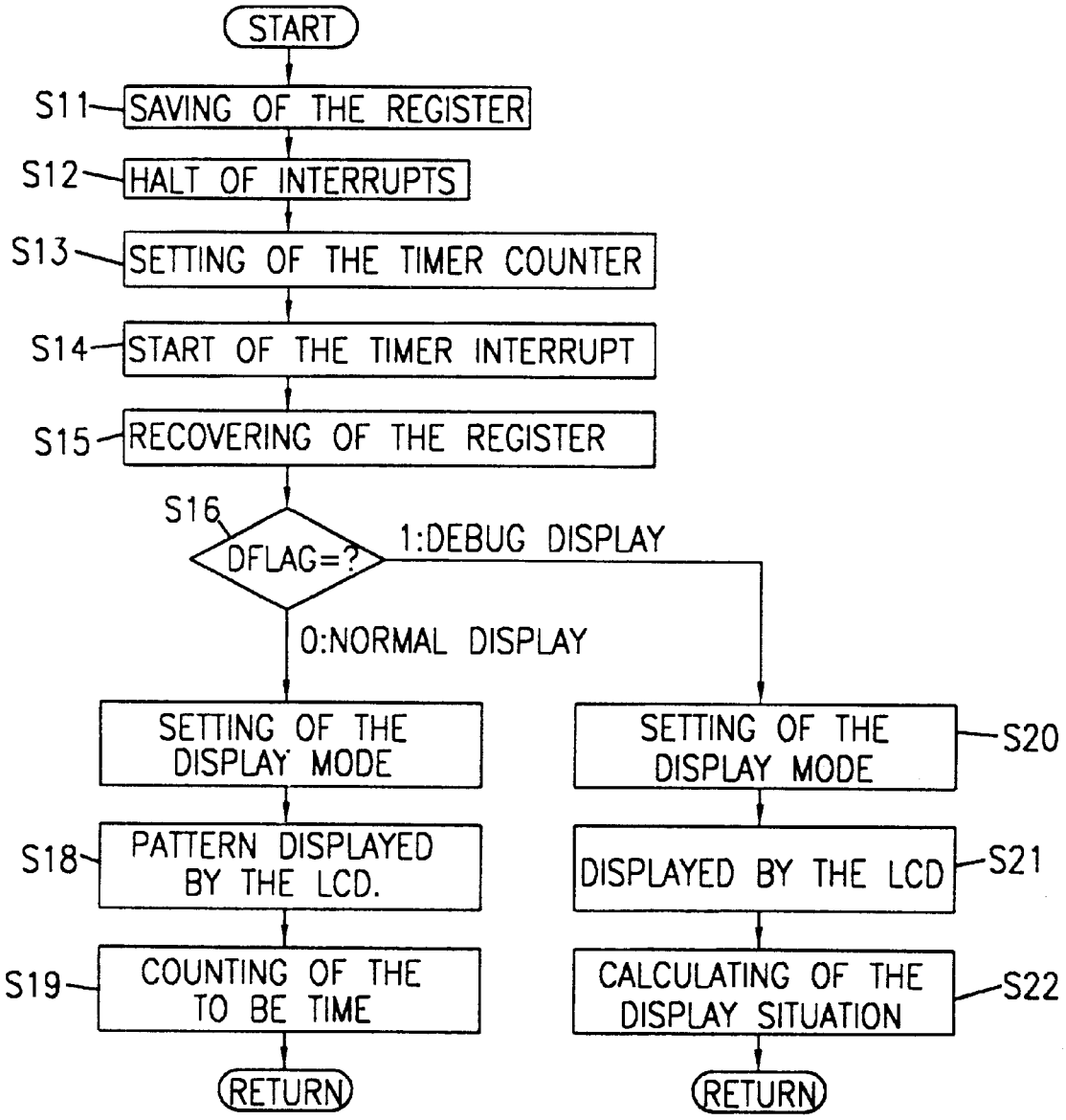
FIG. 15 is a flow chart a timer interrupted routine carried out by the microprocessor of FIG. 9.
Figure 16A:
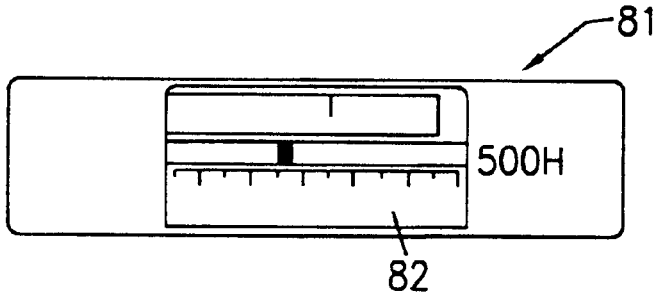
(PRIOR ART) FIG. 16(A)
FIG. 16(A) is a top view of a prior art lamp life meter.
Figure 16B:
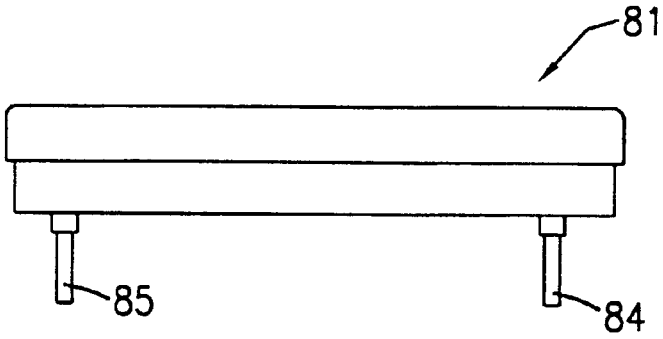
(PRIOR ART) FIG. 16(B)
FIG. 16(B) is a side view of the prior art lamp life meter.
Figure 17:
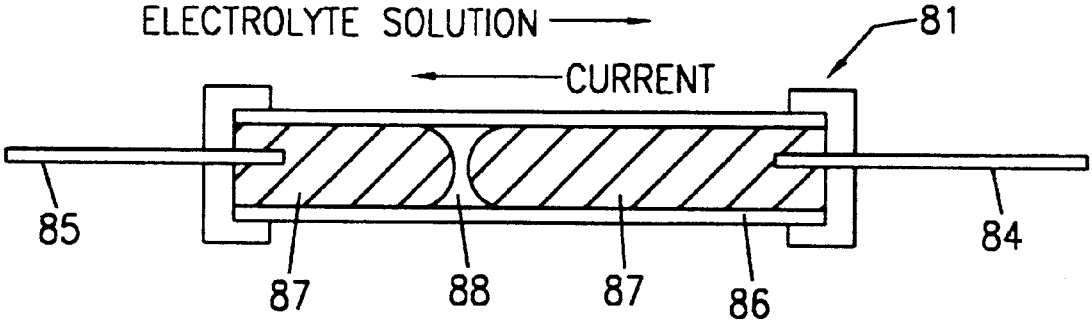
(PRIOR ART) FIG. 17
FIG. 17 is a schematic sectional view of the prior art lamp life meter.

Referring to FIG. 15, the timer interrupt routine will be described. When jumping to the timer interrupt routine, the register is copied to another area to be saved in Step S11. In Step S12, all interrupts are halted so that no other interrupt may arise while the timer interrupt is being handled. Next, the timer-counter is set in Step S13 to allow a timer interrupt to be requested every 1/32 of a second. Then, the timer interrupt procedure is started in Step S14. Next, the copied contents of the register are copied to the register in Step S15 to recover the register.

Next, whether the normal mode or the test mode should be adopted is determined based on the contents of DFLG in step S16. If DFLG=0, the normal mode will be adopted; and if DFLG=1, the test mode will be adopted.

In the case of the normal mode, the display mode is set in Step S17: a display mode is selected from the following three based on the number of frames, the number of seconds, and the lapse of time, and a pattern is displayed by the LCD in Step S18:

i) Not displayed with bars (even second)

ii) Displayed with bars (odd second, odd frame)

iii) Displayed with bars (odd second, even frame)

Next, the total time is counted in Step S19. Then, the program returns to the main routine.

On the other hand, in the case of the test mode, the display mode is set in Step S20. A display mode is selected from the following based on the number of frames and the test procedure, and a pattern is displayed by the LCD in Step S21:

i) Not displayed with bars ii) Displayed with bars (odd frame)

iii) Displayed with bars (even frame)

After calculating the display situation in Step S22, the program returns to the main routine.

A principle characteristics of the lamp life meter 3 according to the preferred embodiment is that it is similar in configuration and requirements to the traditional-type lamp life meter 81 detachably attached to a socket 6*a* that can place a minimal-ampere direct-current voltage between two terminals when lamp 11 is lit, wherein a display indicates the remaining life of the lamp as a function if the total time during which the lamp on direct-current voltage is placed between the two terminals of the socket.

Next, operation of the lamp life meter 3 will be described.

The lamp life meter 3 is attached to the lamp life meter socket 6*a*. When the lamp life meter 3 is first used (in its factory-shipped configuration), an insulating tape 44 is located between the battery 33 and the electrode terminal 52*a* in the battery holder at a position where current flow between the battery 33 and the electrode terminal 52*a* is prevented.

When the user wants to use the lamp life meter 3 for the first time, the insulating tape 44 must be removed. When this is done, the lamp life meter 3 will be on stand-by. When an AC input is provided to the light source unit and a lamp lighting switch (not illustrated) located on the display panel 14 is turned on, a signal is output to the lamp lighting circuit 12 by the control unit 15 to light the lamp 11.

When the lamp 11 is lit, a positive potential is provided to the input terminal 24 simultaneously with lighting of the lamp 11 because the lamp life meter 3 is attached to the socket 6*a*. The input terminal 25 is at the ground potential. (Before positive potential is provided to the terminal 24, the CPU 31 of the lamp life meter 3 is on the sleep mode (standby), and not in counting mode.) When a positive potential is provided to the input terminal 24, the CPU 31 starts to operate for counting, and lights the LCD 26. At the outset, the total elapsed time is 0 hours from which the conducting time will be counted.

In the present embodiment, the total time is displayed by the LCD 26 constituted of nine bars as shown in FIG. 3. Up to a total time of 300 hours, the next right-hand bar is lit every 50 hours. From 300 hours to 500 hours, the next right-hand bar is lit every 100 hours. Above 500 hours, the highest-rank bar (at the far right) is lit. The bar of the LCD 26 for showing the total time blinks every second. Depending on the specifications of the instrument being used, continuous lighting or bar lighting may be selected. The bar pattern displayed by the LCD 26 may be replaced with a matrix display or 7-segment numerical display or any other suitable display.

When the light source unit's main body 2 finishes lighting the lamp 11, the power provided to the lamp life meter socket 6*a* is shut off. When this signal is detected by the CPU 31, the total time counted until that time is backed up by the memory (for example, the RAM 62 in FIG. 10), and the sleep (standby) mode is re-adopted. The data on the total elapsed time backed up by the RAM 62 is saved thanks to the battery 33.

When the lamp 11 is lit again, the total conducting time is counted again based the value backed up the previous time, and the cumulative time can be counted without a break, and displayed.

In the operation test mode, bars of the LCD 26 can be lit one by one or all the bars can be lit at the same time to check whether there are bad cells or not.

The present embodiment has the following merits.

(a) Because it is possible to know how long the lamp life will last, an unexpected shut down or run down of the lamp during operation can be avoided.

(b) Because it is possible to know how long the lamp life will last, the endoscope system including a light source unit can always be used with a feeling of security.

(c) Because it is possible to provide a lamp life meter compatible with the traditional model, existing light source units can be continued to be produced without changing their specifications.

(d) Because means are provided to shut off the embedded power source before the lamp life meter is first used, the battery can be prevented from being consumed, and used for a longer time.

(e) Because an operation test means is arranged in the main body of the lamp life meter, a test operation can be easily performed during the manufacturing process, and production efficiency can be improved.

(f) Because an operation test means is arranged in the main body of the lamp life meter, a test operation can be easily performed during use, and secure services can be offered to the user.

In the above-mentioned embodiment, the lamp life is shown as a function of the total time for which the lamp 11 has been lit. Alternatively, it is possible to directly indicate how much battery time remains. This can be done by subtracting the total time for which the lamp 11 has been lit from the expected life of the lamp (500 hours, for example) and displacing the result.

It is also be possible to use the lamp life meter 3 with different lamp sources whose life expectancies differ. This can easily be done by sending information to the microprocessor indicating the expected life time of the particular lamp being used.

The embodiment described above is applied to an endoscope light source unit 1. Since the essential function of the lamp life meter 3 is to count the time period that an operating signal (e.g. the lamp on signal) appears on the input terminals 24, 25, however, it can also be applied to other fields. [For example, indication of the time when the toner of a copying machine should be replaced, life of VTR head, life of a projector lamp, etc.]

Although the present invention has been described in relation to particular embodiments thereof, many other variations and modifications and other uses will become apparent to those skilled in the art. It is preferred, therefore, that the present invention be limited not by the specific disclosure herein, but; only by the appended claims.

What is claimed is:

1. A lamp life meter adapted to be detachably coupled to a light source of the type which generates a lamp on signal indicating that a lamp of said light source is turned on, said lamp life meter detecting the total length of time that the lamp is turned on, said lamp life meter comprising:

a housing having at least one contact terminal adapted to be coupled to one or more output terminals of said light source, said lamp on signal appearing on one or more of said output terminals;

a clock generator located in said housing and generating clock signals;

a counter located in said housing and counting said clock signals whenever said lamp or signal indicates that said lamp is on; and a display mounted in said housing for displaying an indication of the time said lamp has been turned on.

2. A lamp life meter according to claim 1, wherein said at least one contact terminal is two contact terminals which extend externally of said housing and are parallel to and spaced apart from one another.

3. A lamp life meter according to claim 2, wherein said clock counts said clock signals whenever a current of approximately 15 $\mu$amperes flows through at least one of said two contact terminals.

4. A lamp life meter according to claim 1, wherein said clock counts said clock signals whenever a current of approximately 15 $\mu$amperes flows through at least one of said at least one contact terminal.

5. A lamp life meter according to claim 1, further including a power source located in said housing for powering said lamp life meter.

6. A lamp life meter according to claim 5, wherein said power source is a battery.

7. A lamp life meter according to claim 6, further including a switch for preventing power from said battery being applied to said clock and said counter and said display.

8. A lamp life meter according to claim 7, wherein said switch comprises an insulating tab moveable between a first position wherein it prevents power from said battery from being applied to said counter, said clock and said display and a second position wherein it permits power from said battery to be applied to said clock, said counter and said display.

9. A lamp life meter according to claim 8, wherein said tab is slidable between said first and second positions.

10. A lamp life meter according to claim 8, wherein said tab is removed from said housing when it is in said second position.

11. A lamp life meter according to claim 8, wherein said tab is located at least partially inside said housing when it is in said second position.

12. A lamp life meter according to claim 8, wherein said tab has an indication formed thereon indicating the direction said tab must be moved to bring it from said first to said second position.

13. A lamp life meter according to claim 12, wherein said indication is an arrow shaped head formed on one end of said tab.

14. A lamp life meter according to claim 8, wherein said tab has an insulating section and a conducting section and wherein said insulating section is located between said battery and said clock., counter and display when said tab is in said first position and wherein said conducting section is located between said battery and said clock, counter and display when said tab is in said second position.

15. A lamp life meter according to claim 7, wherein said switch is a tab which is located between said battery and said clock, counter and display, said tab having an insulating section and a conducting section and being moveable between a first position wherein said insulating section is located between said battery and said clock, counter and display and a second position wherein said conducting section is located between said battery and said clock, counter and display.

16. A lamp life meter according to claim 15, wherein said conducting section has a conductive material formed over an insulating substrate.

17. A lamp life meter according to claim 15, wherein said conducting section is a hole formed in said tab.

18. A lamp life meter according to claim 15, wherein said tab is moveable to a third position wherein said tab is removed from said housing.

19. A lamp life meter according to claim 8, wherein said tab includes a perforated portion which can be torn off from the remainder of said tab..

20. A lamp life meter according to claim 1, wherein said display includes a plurality of LED's and wherein said LED's are lit in different patterns to indicate the time period that said light has been lit.

21. A lamp life meter according to claim 20, wherein said LED's flash when they are lit.

22. A lamp life meter according to claim 1, wherein said counter is a programmed microprocessor.

23. A lamp life meter according to claim 22, wherein said microprocessor is programmed to carry out one or more tests concerning the operation of said lamp life meter.

24. A lamp life meter according to claim 23, wherein at least one of said tests is a test to determine if said display is working properly.

25. A lamp life meter according to claim 24, wherein at least a second of said tests is a test to determine if said counter is working properly.

26. A lamp life meter according to claim 23, wherein at least one of said tests is a test to determine if said counter is working properly.

27. A lamp life meter according to claim 1, wherein said display indicates when the expected life of said lamp is exceeded.

28. A lamp life meter according to claim 1, wherein said counter is a programmed microprocessor and wherein said microprocessor backs up the count of said counter when said lamp on signal is removed from said at least one contact terminal.

29. A lamp life meter according to claim 28, wherein said microprocessor backs up said count to a non-volatile memory.

30. A lamp life meter according to claim 1, wherein said counter is a programmed microprocessor and wherein said microprocessor switches to a sleep mode when said lamp on signal does not appear at said at least one contact terminal.

31. The combination, comprising:

A) a light source having a lamp for generating light, said light source generating a lamp on signal at an output terminal thereof when said lamp is lit;

B) a lamp life meter comprising:

1) a housing having at least one contact terminal adapted to be coupled to said output terminal of said light source;
2) a clock generator located in said housing and generating clock signals;
3) a counter located in said housing and counting said clock signals whenever said clock on signal indicates that said lamp is lit; and
4) a display mounted in said housing for displaying an indication of the time said lamp has been turned on.

32. The combination of claim 31, further including a power source located in said housing for powering said lamp life meter.

33. The combination according to claim 32, wherein said power source is a battery.

34. The combination according to claim 33, further including a switch for preventing power from said battery from being applied to said clock, counter and display.

35. The combination according to claim 34, wherein said switch comprises an insulating tab moveable between a first position wherein it prevents power from said battery from being applied to said clock, counter and display and a second position wherein it permits power from said battery to be applied to said clock, counter and display.

36. The combination according to claim 35, wherein said tab is slidable between said first and second positions.

37. The combination according to claim 35, wherein said tab is removed from said housing when it is in said second position.

38. The combination according to claim 35, wherein said tab is located at least partially inside said housing when it is in said second position.

39. The combination according to claim 35, wherein said tab has an indication formed therein indicating the direction said tab must be moved to bring it from said first to said second position.

40. The combination according to claim 39, wherein said indication is an arrow shaped head formed on one end of said tab.

41. The combination according to claim 35, wherein said tab has an insulating section and a conducting section and wherein said insulating section is located between said battery and said clock, counter and display when said tab is in said first position and wherein said conducting section is located between said battery and said clock, counter and display when said tab is in said second position.

42. The combination according to claim 34, wherein said switch is a tab which is located between said battery and said counter, clock and display, said tab having an insulating section and a conducting section and being moveable between a first position wherein said insulating section is located between said battery and said clock, counter and display and a second position wherein said conducting section is located between said battery and said clock, counter and display.

43. The combination according to claim 42, wherein said conducting section has a conductive material formed over an insulating substrate.

44. The combination according to claim 42, wherein said conducting section is a hole formed in said tab.

45. The combination according to claim 42, wherein said tab is moveable to a third position wherein said tab is removed from said housing.

46. The combination according to claim 35, wherein said tab includes a perforated portion which can be torn off from the remainder of said tab.

47. The combination according to claim 31, wherein said display includes a plurality of LED's and wherein said LED's are lit in different patterns to indicate the time period that said light has been lit.

48. The combination according to claim 47, wherein said LED's flash when they are lit.

49. The combination according to claim 31, wherein said counter is a programmed microprocessor.

50. The combination according to claim 49, wherein said microprocessor is programmed to carry out one or more tests concerning the operation of said lamp life meter.

51. The combination according to claim 50, wherein at least one of said tests is a test to determine if said display is working properly.

52. The combination according to claim 51, wherein at least a second of said tests is a test to determine if said counter is working properly.

53. The combination according to claim 50, wherein at least one of said tests is a test to determine if said counter is working properly.

54. The combination according to claim 31, wherein said display indicates when the expected life of said lamp is exceeded.

55. The combination according to claim 31, wherein said counter is a programmed microprocessor and wherein said microprocessor backs up the count of said counter when said lamp on signal is removed from said at least one contact terminal.

56. The combination according to claim 55, wherein said microprocessor backs up said count to a non-volatile memory.

57. A lamp life meter according to claim 31, wherein said counter is a programmed microprocessor and wherein said microprocessor switches to a sleep mode when said lamp on signal does not appear at said at least one contact terminal.

* * * * *